US007374071B2

(12) United States Patent
Lavelle

(10) Patent No.: US 7,374,071 B2
(45) Date of Patent: May 20, 2008

(54) BACKPACK, POUCH OR CLOTHING WITH INTEGRAL RAINGEAR

(76) Inventor: Robert E. Lavelle, 9251 Highway 78 W. Lot 73, Okeechobee, FL (US) 34974

( * ) Notice: Subject to any disclaimer, the term of this patent is extended or adjusted under 35 U.S.C. 154(b) by 405 days.

(21) Appl. No.: 10/900,541

(22) Filed: Jul. 28, 2004

(65) Prior Publication Data

US 2005/0056669 A1 Mar. 17, 2005

Related U.S. Application Data

(63) Continuation-in-part of application No. 10/142,690, filed on May 4, 2002, now abandoned.

(51) Int. Cl.
*A41D 1/00* (2006.01)

(52) U.S. Cl. ..... 224/153; 2/94

(58) Field of Classification Search ..... 224/153; 2/94

See application file for complete search history.

(56) References Cited

U.S. PATENT DOCUMENTS 1,099,031 A * 6/1914 Fligel ..... 2/84
2,839,757 A * 6/1958 Gianola ..... 2/205
2,870,451 A * 1/1959 Brodsky ..... 2/200.1
4,689,831 A * 9/1987 Greenberger et al. ..... 2/93
5,165,111 A * 11/1992 Lieberman ..... 2/94
5,676,293 A * 10/1997 Farris ..... 224/576
6,393,613 B1 * 5/2002 Sheu ..... 2/94
2002/0139821 A1 * 10/2002 Fleischli ..... 224/153

FOREIGN PATENT DOCUMENTS

FR 2553981 * 10/1983
GB 2197582 * 5/1988

* cited by examiner

*Primary Examiner*—Tri M Mai
(74) *Attorney, Agent, or Firm*—Norman Friedland

(57) ABSTRACT

In one embodiment the raingear is housed in a pocket located on the top of the backpack so as to allow the wearer to reach over his shoulders to grab hold of a portion of the raingear and lift it out of the pocket and allow it to drape over the entire body of the wearer and backpack. The raingear includes an attachment to the backpack so that it stays attached to the backpack to assure that the raingear will be returned to the pocket. The other embodiment houses the raingear in its own self-contained package that is attachable to the backpack or jacket of a fishing or hunting jacket and the like. The donning and the attachment of the raingear is substantially identical to the first embodiment.

4 Claims, 6 Drawing Sheets

BACKPACK, POUCH OR CLOTHING WITH INTEGRAL RAINGEAR

CROSS-REFERENCE TO RELATED APPLICATION

This is a continuation-in-part of U.S. patent application Ser. No. 10/142,690 filed on May 4, 2002, now abandoned.

STATEMENT REGARDING FEDERALLY SPONSORED RESEARCH OR DEVELOPMENT

None

TECHNICAL FIELD

This invention relates to the combination of backpack and raingear and particularly to raingear that is made integral with or detachable from a backpack or other article of wear with the capability of discretely removing the raingear from the backpack and donning the raingear on the user and providing means to assure the return of the raingear to the backpack.

BACKGROUND OF THE INVENTION

There are sundry back packs and raingear available in the prior art and as one skilled in this art appreciates there is a considerable amount of prior art where the raingear is stored in a back pack or tote bag or the like. Exemplary of such articles are disclosed is the following patents:

French Patent No. 2,553,981 granted to Aime Samuel Achour on Oct. 28, 1983. The raingear in the backpack disclosed in this patent is stored in a pocket adjacent to the back of the wearer and is the backpack is removed from the wearer to get at the raingear.

U.S. Pat. No. 36,685 granted to Brecht et al on Oct. 14, 1862 a combination a backpack that is converted into tent, mattress and raingear and it also must be removed from the user to accommodate these various uses.

U.S. Pat. No. 261,109 granted to Watkinson on Jul. 11, 1882 discloses a tote bag that stores raingear.

U.S. Pat. No. 1,340,351 granted to Whall on May 18, 1920 discloses a foldable raingear.

U.S. Pat. No. 2,967,306 granted to Fabanich on Jan. 10, 1961 is a combined raingear, seat and foldable for ease of carrying adapted particularly for hunters.

U.S. Pat. No. 5,165,111 to Lieberman discloses a backpack with integral garment. In Lieberman, the integral garment is stored in an internal compartment formed continuously along a central panel on the inside of the backpack. The garment may be deployed without removing the backpack from the user's back. However, the Lieberman invention is difficult to deploy by the user since the package that stores the garment is zippered and near the user's back. Moreover, the pack must be constructed of waterproof material since the garment does not cover the pack.

U.S. Pat. No. 5,407,112 granted to Christodoulou et al on Apr. 18, 1995 discloses a combined backpack that stores a raincoat in a pocket located at the top of the backpack and is covered by a detachable tote back that overlies the pocket that stores the raincoat.

U.S. Pat. No. 5,526,969 to Greenberger discloses a backpack that is convertible between a backpack mode and a backpack and protective outer gear mode. The protective outerwear is stored inside of a first pocket. The Greenberger invention suffers from the same problems associated with Christodoulou invention, in that it cannot be quickly deployed without the assistance of another.

U.S. Pat. No. 5,743,448 granted to Tsai on Apr. 28, 1998 which teaches a combined raincoat and backpack where the raincoat conceals the backpack. The raincoat is stored in an interior surface on the front surface of the backpack, i.e. between the backpack and the back of the wearer.

U.S. Pat. No. 6,393,613 granted to Sheu on May 28, 2002 discloses a packet that is held by Velcro® to any of the various facets of the back pack and is removable. The packet stores raingear so that the packet is removed from the backpack when it is desired to dawn the raingear.

This invention solves at least two problems that are not considered nor suggested in the prior art. Namely, the raingear is stored in and attached to the backpack in such a way that it is accessible when the backpack is being worn by the user to the extent that a simple movement of the guide strap allows the user to pull the raingear out of the backpack and don the raingear in a single motion to cover both himself and the backpack. In addition, since the raingear is tied to the pocket of the backpack in such a manner that when deployed the tie does not affect the operation of the donning of the raingear and assures that the raingear will be stored back in the backpack. What this obviates is the preclusion of leaving the raincoat outside of the backpack and forgetting or being too lazy to put it back therein. This will attempt to solve the problem that school children have that lose the raincoat because they have the propensity of forgetting to put or just not putting the raincoat back into the pocket of the heretofore known types of backpacks or tote bags.

In another embodiment of this invention, the raingear is stored in its own flexible container or pouch which is capable of being attached to, mounted in a pocket of or mounted on the top of the backpack. This embodiment operates in the same way as that described in the above paragraphs. Obviously, since the raingear is already packaged, it can be also utilized in combination with other types of articles, such as fishing vests, hunting vest and other types of outdoor clothing. The clothing just mentioned, would require a fastener that complements the fastener on the package containing the raingear so as to be able to be attached thereto and detachable therefrom or alternatively the pouch could be formed integrally on the back of the clothing and accessible to the wearer while on the wearer.

SUMMARY OF THE INVENTION

An object of this invention is an improved the combined backpack and raingear that is deployable while on the back of the user. The raingear includes a guide strap to assist in the deployment and a retaining strap to attach the raingear to the pocket of the backpack. The raingear serves to protect the user as well as the backpack and its contents. The raingear could equally be inserted into a pouch and the pouch could be inserted in the pocket of the backpack or a pouch could be sewn onto or made integral with a vest or jacket so that the raingear would be removable from the pouch, inserted over the body and returned to the pouch in much manner as described with the backpack.

A feature of this invention is that in one embodiment the raingear and its package is adaptable to be used in combination with fishing vests, hunting vests and the like. In this embodiments, a detachable roll or covering storing the raingear can be affixed to shoulder straps at a location behind the neck or head of the user. The detachable roll may also include means for attaching it to the top of the backpack or to vests of the articles of wear as described above.

The combined backpack and raingear of this invention is characterized as being versatile and durable. In the other embodiment of this invention, the raingear is stored in a pocket atop of the backpack. The user pulls a cord or tab or guide strap to deploy the raingear. A forward motion causes the raingear to be removed and the user merely pulls it over the wear's head, and the fore portion drapes down over the front of the wearer and the aft portion of the raingear merely drapes down over the back of the wearer and over the backpack. In either embodiment the raingear can be a one piece slip-over unit or can be one that includes a fore and aft section that can be snapped or buttoned to form a poncho type of raingear.

The foregoing and other features of the present invention will become more apparent from the following description and accompanying drawings.

Figure 1:
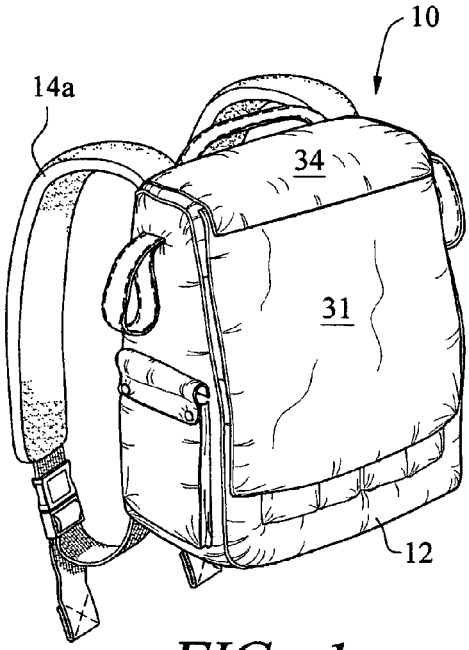
FIG. 1 is a perspective view of this invention illustrating the backpack with the raingear being stored in a top pocket.
Figure 2:
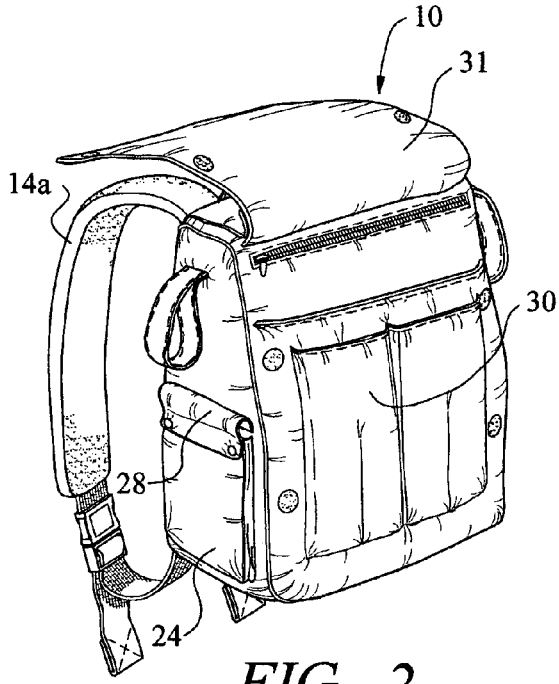
FIG. 2 is a perspective view of the embodiment of FIG. 1 illustrating the removal of the flap shielding the various pockets of the backpack.
Figure 3:
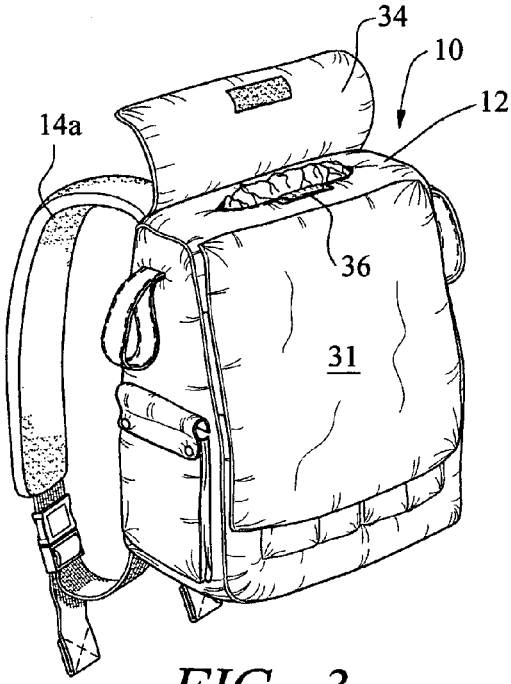
FIG. 3 is a perspectives view of the embodiment of FIG. 1 illustrating the flap that encloses the pocket of the raingear and the guide strap.
Figure 4:
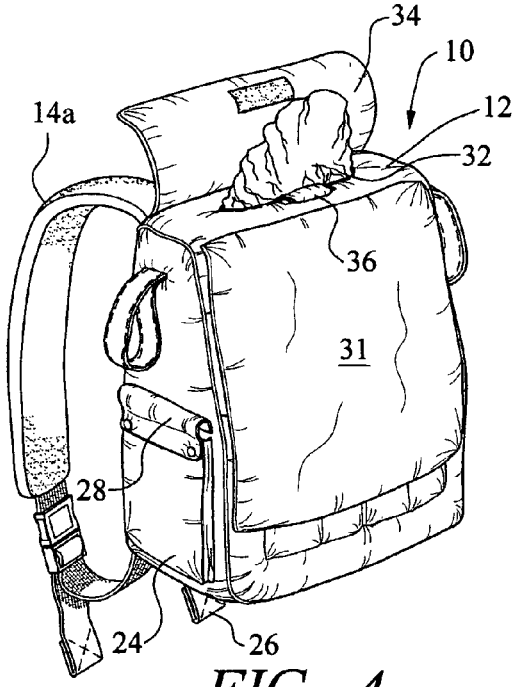
FIG. 4 is a perspective view of the embodiment of FIG. 1 illustrating the beginning of the removal of the raingear from its pocket.
Figure 5A:
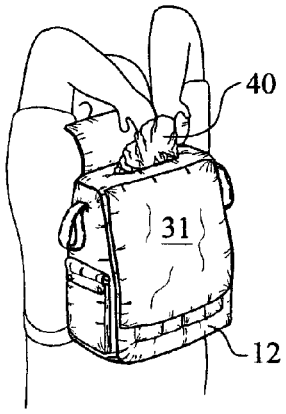
FIGS. 5A, 5B, 5C, 5D and 5E are perspective views illustrating the sequence for donning the raingear from the combined backpack and raingear of this invention.
Figure 5B:
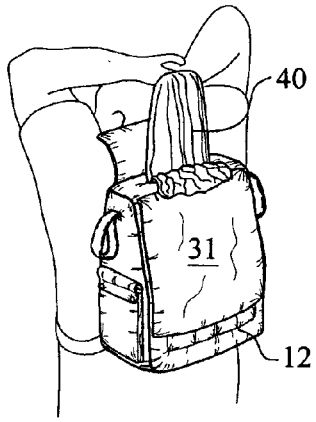
Figure 5C:
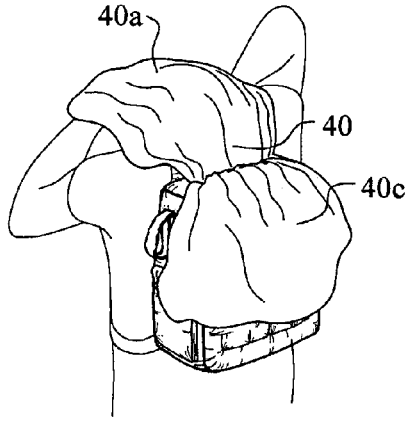
Figure 5D:
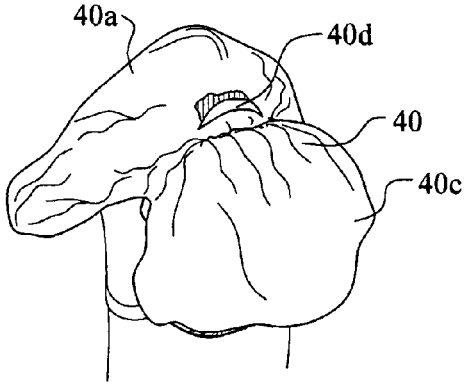
Figure 5E:
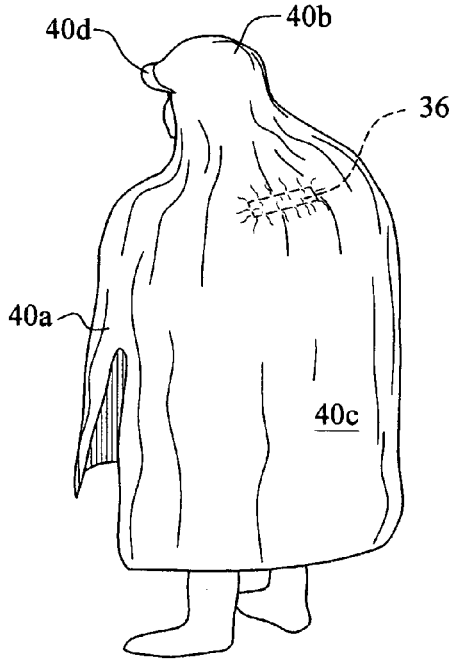

These figures merely serve to further clarify and illustrate the present invention and are not intended to limit the scope thereof.

DETAILED DESCRIPTION OF THE INVENTION

While this invention is being described in its preferred embodiments as being utilized in a back pack and particular poncho-like configuration, the specific details described in the application can be altered without departing from the scope of this application inasmuch as the invention is essentially concerned with the deployment of the backpack while on the back of the wearer and the concept of joining the raingear to the pocket of the backpack or poncho-type design so that the raingear will be returned to its original storage position and not left behind. These features will become clearer from the description to follow.

Reference will be made to FIGS. 1 through 6C for a better understanding of this invention where the combined backpack and raingear is illustrated by reference numeral 10. The backpack can be any commercially available backpack that is modified to incorporate the inventive raingear or it can be made up to include the invention. As illustrative and not by way of being limited, the backpack described herein includes a front panel 12, a back panel 14, a top panel 16, a bottom panel 18 and opposing side panels 20 and 22, defining a bag-like structure with a plurality of pockets formed therein. As for example, the backpack 10 can include side pocket 24 with a top opening 26 and a folding cover 28, a front pocket 30 under flap 31 and as many pockets that may be desirable for the user. As is typical in backpacks, secured to the back panel 14 are a pair of adjustable holding straps 14*a* (one being shown) that serve to hold the backpack to the back of the wearer. The material of the backpack may be any suitable commercially available textile fabric such as denim or canvas and the like or it can be made from a plastic, such as vinyl and the like. It being understood that this construction does not constitute the present invention.

In accordance with this invention, the top panel 12 houses a pocket 32 that is located under flap 34 that contains the raingear 34. While it may include pull strap attached to the free end of raingear 34 in the preferred embodiment the raingear is directly accessible to the wearer, notwithstanding that the backpack is mounted on the wearer's back, and will emerge from the opening 36 of the pocket 32 as the wearer pulls thereon. A Velcro® fastner may be attached to the inner surface 38 of the flap 34 and the top portion 16 of the backpack 10. As noted from FIGS. 3 and 4 as the flap 34 is opened the wearer has access to bottom portion of the raingear 40 and the user can now grab hold of the raingear 40 by the edges adjacent to said bottom portion and lift it out of the pocket 32 and raise it over the wearer's head so that the front portion will fall over the front of his body and the back portion will fall over the back of the wearer and the backpack itself. It will be appreciated that the raingear may be a light weight plastic material such as vinyl or Mylar or the like and is made in a single sheet with a top opening 42 to allow the face to be uncovered. The particular configuration of the raingear can take any form so long as it is sufficiently light weight to fit into pocket 32.

Figure 6A:
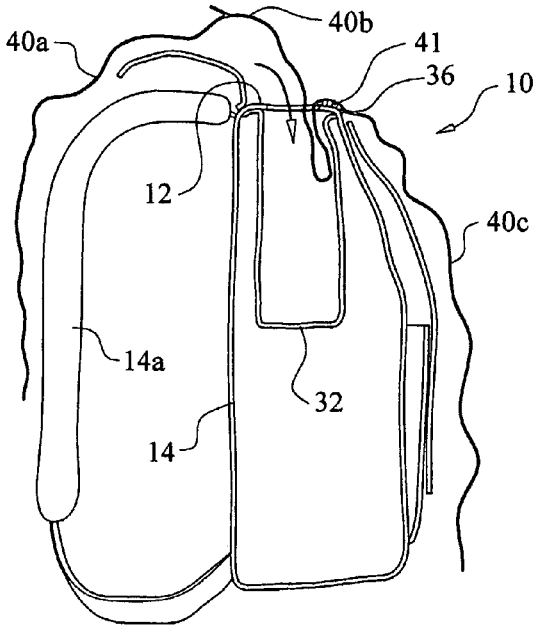
FIGS. 6A, 6B and 6C are schematic views illustrating the return of the raingear back into the pocket of the backpack of this invention.
Figure 6B:
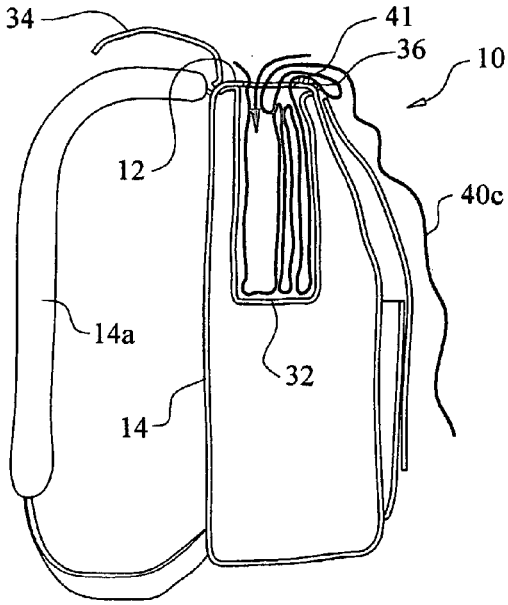
Figure 6C:
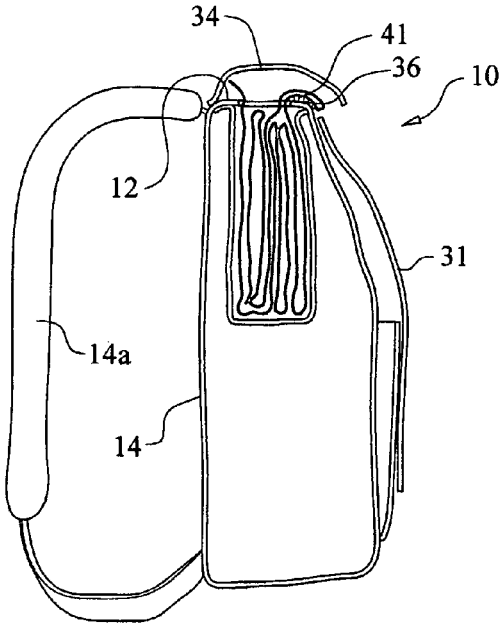

The schematic illustration of FIGS. 6A, 6B and 6C are intended to illustrate how the raingear fits into the pocket and portions of the raingear 40 drapes over the wearer and the backpack. As noted in these Figs. the fore portion 40*a* drapes over the front, the top portion 40*b* lies on the top of the head of the wearer and the rear portion 40*c* lies over the back of the wearer as well as the backpack 10. The raingear 40 is removably attached to the backpack by the Velcro® tapes (hooks and plush fabric) attached to the raingear and the backpack adjacent to the pocket 32. The attachment need not be removable and according to this invention, this element serves to assure that the raingear will be returned to pocket 32 after it is removed from the wearer as will be more fully described from the description to follow.

FIGS. 5A through 5E simply illustrate the donning process of the raingear. Suffice it to say that since the raingear protrudes through or is in close proximity to the opening of pocket 32, the wearer merely reaches over the back of his head and grabs on to the raingear and pulls until it is fully extended and deployed. The front panel 40*a* will naturally fall in the front of the wearer, the top panel 40*b* will rest on the head of the wearer and the rear panel 40*c* will naturally drop so as to drape the back of the wearer. An opening 40*e* in the raingear will allow the face to be exposed and a visor 40*d* could be included as a further protection of the face against the rain. It will be appreciated that the raingear also covers the backpack and protects it against the rain. Since the raingear is secured to the backpack by the Velcro® tape the wearer after removing the raingear from his body merely has to fit the raingear back in the pocket 32. Since there is a propensity of simply leaving the raingear out of the backpack in heretofore known designs, the present invention eliminates this occurrence or at the very least places an obstacle for not returning the raingear in its original storage container.

The next embodiment is shown to exemplify this invention when it is self-contained in its own bag that is capable of being attached to a backpack, or the jacket of a hunting jacket or fishing jacket or the like. Hence, substantially the same procedure of donning and returning the raingear to the bag is accomplished as is described in connection with the combined backpack and raingear described in the configuration depicted in FIGS. 1 through 6C. For a better understanding of the other embodiment reference should be made to FIGS. 7 and 8. As noted the backpack depicted in FIG. 1 is used for explanatory purposes and any other item, like the vest of a hunting outfit or a fishing jacket or the like could easily be substituted therefore and are deemed to be within the scope of this invention. In this embodiment the raingear 40 (like elements depicted in all the Figs. are assigned the same reference numerals) is stored in the roll-up bag 70. The roll-up bag 70 may include a front opening that serves to allow the wearer to grab the raingear 40 and don it as would be done similar to the method depicted in FIGS. 5A through 5E, or alternatively, the roll-up bag 70 could be fabricated in a pocket with an opening on the top and it likewise would serve the same purpose as that depicted in these latter mentioned Figs. Suffice it to say that the element 70 includes suitable fasteners 72, which can be in the form of commercially available snaps or Velcro® tapes. Obviously, the bag 70 can be suitably fastened to the jacket of a hunting or fishing jacket or the like as well as the backpack, as shown. Alternatively, the clothing could include a pocket similar to the pocket of the backpack and the raingear could be inserted in the pocket and the attachments would be made in the pocket so that the wearer can don and return the raingear in the same manner as described in the earlier paragraphs. Alternately, without departing from the scope of this invention, the raingear can be attached to a separate pouch, which pouch is adapted to be affixed to the pocket of the backpack. Again, the donning and returning of the raingear in each embodiment remains the same.

Figure 9A:
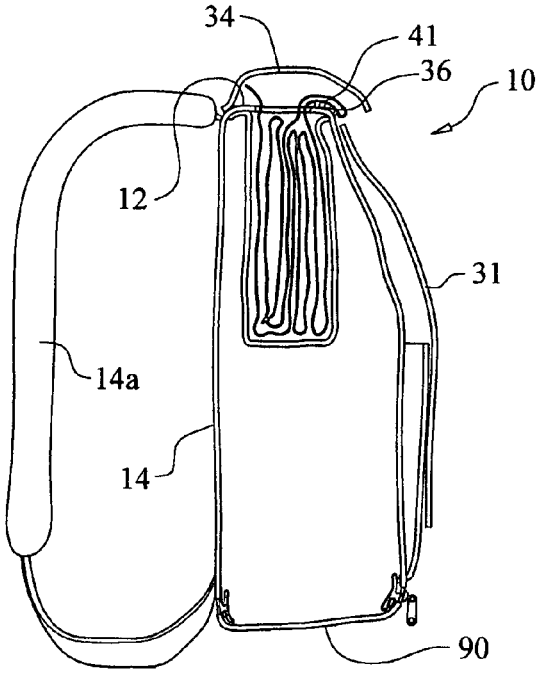
FIG. 9A exemplifies another embodiment of this invention where the backpack is made to be extended to a larger size.
Figure 9B:
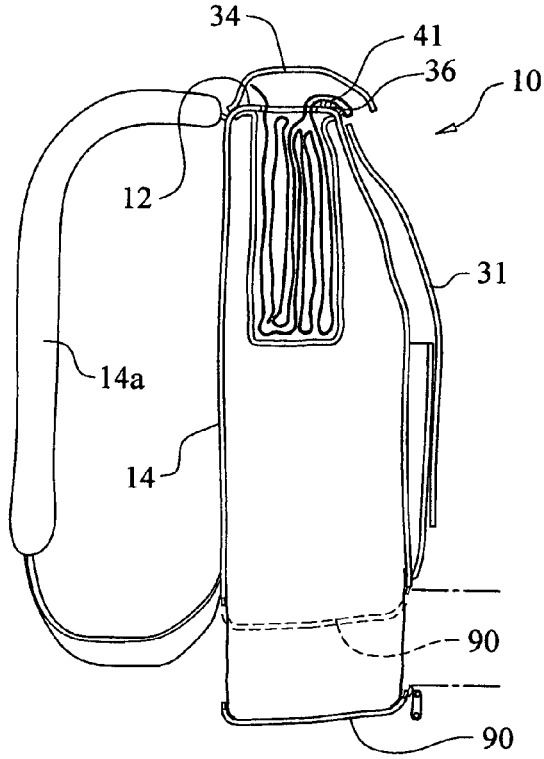
FIG. 9B is identical to the embodiment depicted in FIG. 9A in the deployed position.
Figure 10:
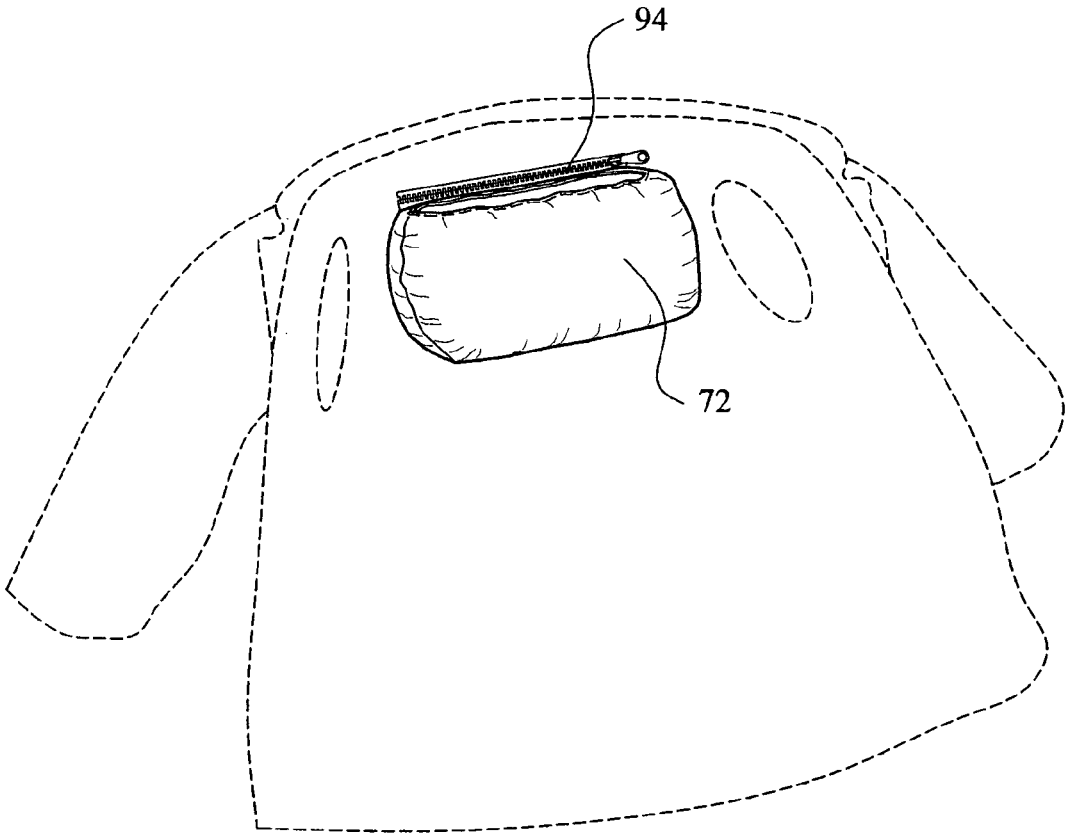
FIG. 10 is a view in elevation and phantom that exemplifies another embodiment of this invention and is substantially similar to the embodiment depicted in FIG. 7 illustrating the versatility of this invention.

FIGS. 9A and 9B illustrate another embodiment of this invention where the backpack can be designed to be extended in order to increase the volume of the storage area of the backpack. As shown in FIG. 9A the a suitable commercially available zipper 90 is mounted at the bottom of the backpack when in the stored position. When unzippered as shown in FIG. 9B the additional material added to the backpack in order to increase the carrying volume causes the material to drop to a lower position as shown in the drawing.

Figure 7:
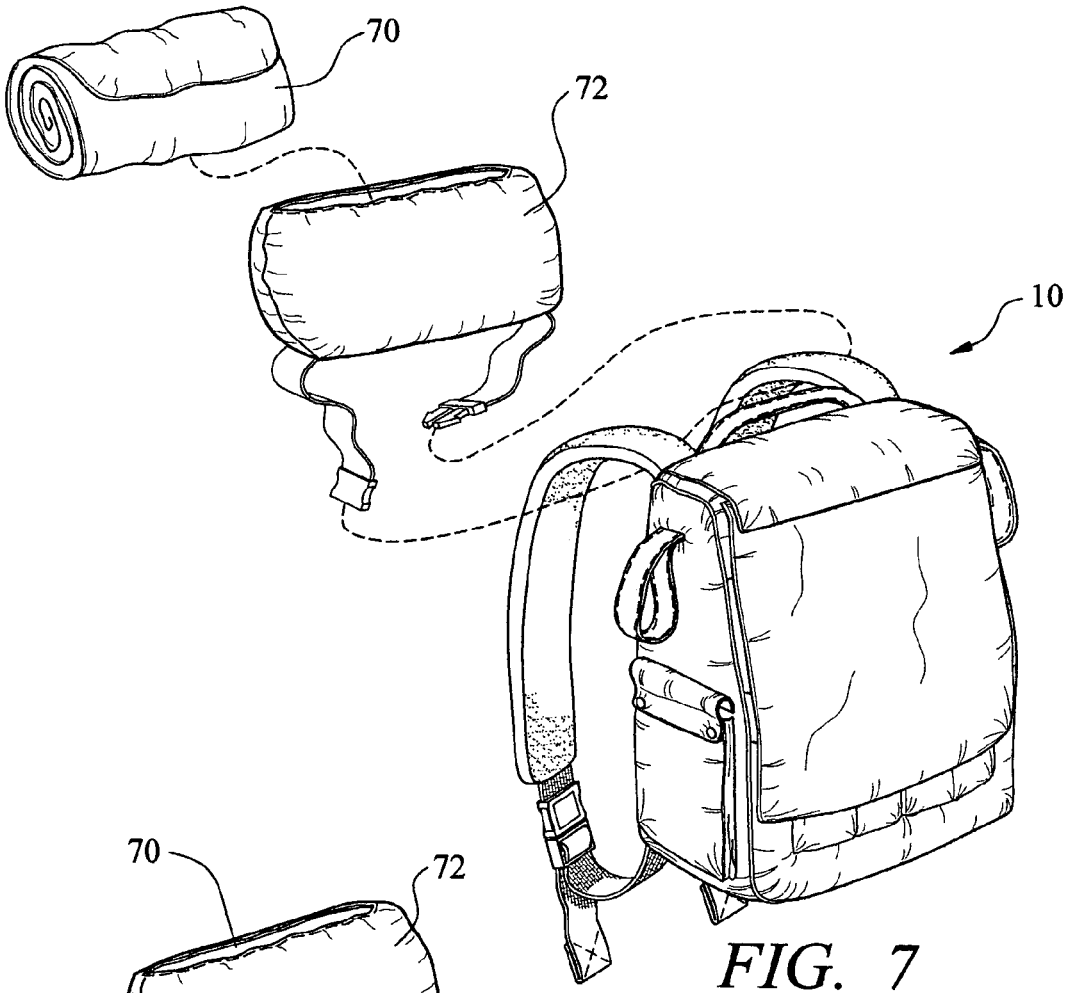
FIG. 7 is an exploded view of a perspective view of another embodiment of this invention where the raingear is mounted in a separate bag or pouch that is removably attachable to another item.
Figure 8:
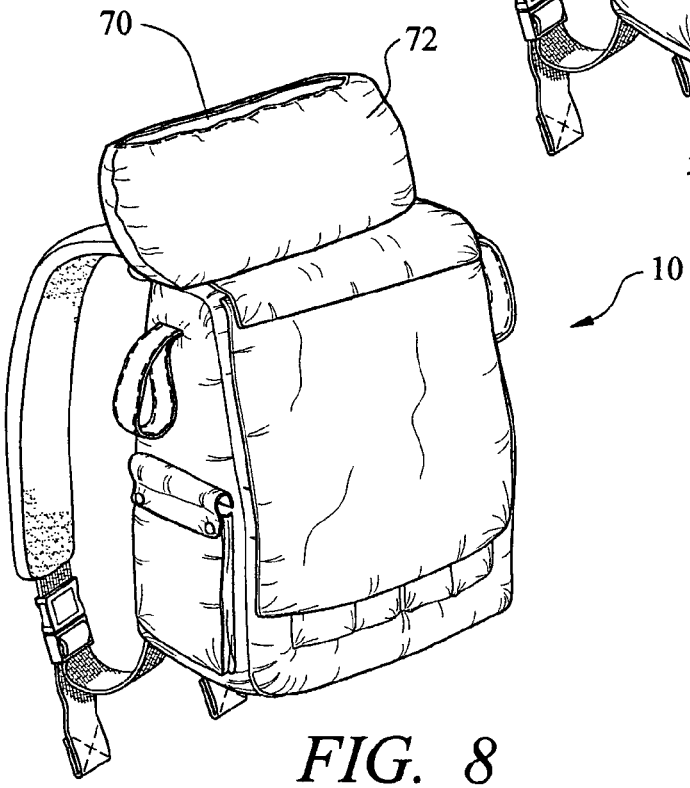
FIG. 8 is a perspective view identical to the structure depicted in FIG. 7 wherein the raingear and its holding bag is mounted on the top of the backpack.

As mentioned earlier in the description the backpack/raingear combination is versatile and has many application. As shown the pouch/raingear combination depicted in FIG. 7 is attached to a garment, which could be a hunting or fishing jacket, a sweater, a shirt and the like which is modified to include either a zipper 94 or Velcro®. As is taught by this invention the raingear is mounted in the pouch 72 and is attached thereto so that when it is returned after being worn, it will be returned back to the pouch 70. Further, the pouch must be located on the garment so that the wearer can reach the raingear and don it while it is mounted on the wearer's back.

What has been shown by this invention is a raingear and its carrying case that is fastened to the back of the wearer so that the wearer can easily remove the raingear from the case or pocket or bag or the like, while still mounted on his person, and drape the raingear over the body and carrying case and the judicious fastening of the raingear to the case provides an incentive to return the raingear back to the case. Or alternatively the carrying case can be made an integral part of the clothing of the wearer.

Although this invention has been shown and described with respect to detailed embodiments thereof, it will be appreciated and understood by those skilled in the art that various changes in form and detail thereof may be made skilled in the art that various changes in form and detail thereof may be made without departing from the spirit and scope of the claimed invention.

What is claimed is:

1. A combined raingear and backpack including a pocket formed within a cavity of the backpack and having an access opening in the backpack at a top wall thereof, said pocket for storing said raingear and being located in a position on the backpack that allows the wearer to gain access to the raingear so that the wearer can pull the raingear out of said pocket through said access opening so as to don the raingear, said raingear having a top end and a bottom end and an opening for the face of the wearer at the top end, said raingear being accessible in said pocket so as to permit the wearer to grab said said raingear to pull said raingear out of said pocket and pull it over the head of the wearer and continues to remove the raingear until it is completely out of said pocket and fitting said raingear over the head of the wearer so that the top end adjacent to said opening of said raingear is on the face of the wearer and allowing said raingear to drape over the wearer and said backpack, and a hook and loop fasteners directly attached to the raingear and to the top wall of the backpack adjacent to the pocket access opening for securing said raingear to said backpack whereby the raingear remains with the backpack after the raingear is removed from the wearer so as to allow the wearer to return the raingear to said pocket.

2. A combined raingear and backpack as claimed in claim 1 wherein said raingear includes a back panel, a front panel and said opening for access to the face of the wearer being formed on said front panel.

3. A combined raingear and backpack as claimed in claim 2 wherein said raingear includes a visor mounted adjacent said opening.

4. In combination, raingear for protection against inclement weather for the wearer and a bag for supporting said raingear, means for attaching the said bag so that it is mounted on the back of the wearer, a pocket formed within a cavity of said bag, an access opening formed on the top wall of said bag for accepting said raingear in said bag so that the wearer can reach over and grab the raingear and pull it over the wearer's body, said raingear having a top end and a bottom end and an opening for the face of the wearer at the top end, said bottom end being accessible to the wearer while in said bag wherein the wearer is permitted to grab said bottom end and remove said raingear from said bag so as to fit it over the head of the wearer and continues to remove the raingear until it is completely out of said pocket and fitting the head of the wearer in the top end adjacent to said opening of said raingear and allowing said raingear to drape over the wearer and said bag, and hook and loop fasteners directly attached to the raingear and to the bag adjacent to said pocket access opening for attaching said raingear to said bag so that the raingear remains in contact with said bag after the raingear is removed from the wear's body.

* * * * *